US009084998B2

(12) United States Patent
Belotserkovskiy

(10) Patent No.: US 9,084,998 B2
(45) Date of Patent: Jul. 21, 2015

(54) METHOD OF CONTROLLING THE OPERATION OF A CONE CRUSHER

(71) Applicant: SANDVIK INTELLECTUAL PROPERTY AB, Sandviken (SE)

(72) Inventor: Konstantin Belotserkovskiy, Malmo (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 14/360,864

(22) PCT Filed: Nov. 13, 2012

(86) PCT No.: PCT/EP2012/072511

§ 371 (c)(1),
(2) Date: May 27, 2014

(87) PCT Pub. No.: WO2013/079318

PCT Pub. Date: Jun. 6, 2013

(65) Prior Publication Data

US 2014/0306041 A1 Oct. 16, 2014

(30) Foreign Application Priority Data

Nov. 28, 2011 (EP) ..... 11190984

(51) Int. Cl.

| | |
|---|---|
| ***B02C 25/00*** | (2006.01) |
| ***B02C 2/04*** | (2006.01) |
| ***B02C 2/00*** | (2006.01) |

(52) U.S. Cl.

CPC ..... *B02C 2/047* (2013.01); *B02C 2/007* (2013.01); *B02C 2/04* (2013.01); *B02C 2/042* (2013.01); *B02C 25/00* (2013.01)

(58) Field of Classification Search

CPC ..... B02C 25/00; B02C 2/007
USPC ..... 241/35–37, 207–216
See application file for complete search history.

(56) References Cited

U.S. PATENT DOCUMENTS 4,428,535 A * 1/1984 Venetucci ..... 241/35
2010/0181397 A1 7/2010 Wallin

FOREIGN PATENT DOCUMENTS

EP 0203026 A2 11/1986

* cited by examiner

*Primary Examiner* — Faye Francis
(74) *Attorney, Agent, or Firm* — Corinne R Gorski

(57) ABSTRACT

A cone crusher includes a crushing chamber formed between inner and outer crushing shells, a drive shaft that gyrates the crushing head to crush material in the crushing chamber, and a feeding hopper for feeding material to the crushing chamber. A measurement device measures an amount of material present in the feeding hopper. A control system controls, based on the measured amount of material present in the feeding hopper, at least one crusher operating parameter which is chosen from i) an rpm of the drive shaft, and ii) a width of a discharge opening formed between the inner crushing shell and the outer crushing shell.

17 Claims, 3 Drawing Sheets

METHOD OF CONTROLLING THE OPERATION OF A CONE CRUSHER

RELATED APPLICATION DATA

This application is a §371 National Stage Application of PCT International Application No. PCT/EP2012/072511 filed Nov. 13, 2012 claiming priority of EP Application No. 11190984.2, filed Nov. 28, 2011.

TECHNICAL FIELD OF THE INVENTION

The present invention relates to a method of controlling the crushing of material in a cone crusher comprising an inner crushing shell, supported on a crushing head, and an outer crushing shell, the inner and outer crushing shells forming between them a crushing chamber.

The present invention further relates to a cone crusher of the above referenced type and further comprising a motor driving a drive shaft adapted to make the crushing head gyrate to crush material in the crushing chamber, and a feeding hopper arranged for feeding material to the crushing chamber.

BACKGROUND OF THE INVENTION

A cone crusher may be utilized for efficient crushing of material, such as stone, ore, etc. An example of a cone crusher can be found in EP 2 116 307 disclosing a cone crusher of the inertia cone crusher type. Material to be crushed is fed from a feeding hopper into a crushing chamber formed between an outer crushing shell, which is mounted in a frame, and an inner crushing shell, which is mounted on a crushing head. The crushing head is mounted on a crushing head shaft. In an inertia cone crusher an unbalance weight is arranged on a cylindrical sleeve-shaped unbalance bushing encircling the crushing head shaft. The cylindrical sleeve is, via a drive shaft, connected to a pulley. A motor is operative for rotating the pulley and, hence, the cylindrical sleeve. Such rotation causes the unbalance weight to rotate and to swing to the side, causing the crushing shaft, the crushing head, and the inner crushing shell to gyrate and to crush material in the crushing chamber. If the crushing chamber is emptied of material there is a certain risk that the inner crushing shell may get into contact with the outer crushing shell, resulting in wear.

SUMMARY OF THE INVENTION

An object of the present invention is therefore to facilitate controlling of a cone crusher and to optimize the crushing efficiency.

This object is achieved by means of a method of controlling the crushing of material in a cone crusher comprising an inner crushing shell, supported on a crushing head, and an outer crushing shell, the inner and outer crushing shells forming between them a crushing chamber, the method comprising:

supplying material to a feeding hopper arranged above the crushing chamber, feeding material from the feeding hopper to the crushing chamber, bringing the crushing head to gyrate by means of a drive shaft driven by a drive motor to crush the material in the crushing chamber, measuring an amount of material that is present in the feeding hopper, and controlling, based on the measured amount of material present in the feeding hopper, at least one crusher operating parameter which is chosen among:

i) an rpm of the drive shaft, and ii) a width of a discharge opening formed between the inner crushing shell and the outer crushing shell.

An advantage of this method is that the cone crusher can operate and continue to crush material in an efficient manner also in situations when the supply of material cannot be accurately controlled.

According to one embodiment the method further comprises controlling, when the measured amount of material present in the feeding hopper falls below a minimum amount, at least one of said crusher operating parameters to increase the amount of material present in the feeding hopper. An advantage of this embodiment is that the feeding hopper will not be emptied of material when the supply of material to the feeding hopper is reduced or even stopped. Hence, crushing operation may continue, but at a lower amount of material being crushed per unit of time.

According to one embodiment said step of measuring an amount of material that is present in the feeding hopper comprises measuring a level and/or a weight of the material present in the feeding hopper. An advantage of this embodiment is that measurement of level and/or weight provides an accurate and cost efficient measurement of the amount of material that is present in the feeding hopper.

According to one embodiment the method further comprises controlling, when the measured amount of material present in the feeding hopper exceeds a maximum amount, at least one of said crusher operating parameters to reduce the amount of material present in the feeding hopper. An advantage of this embodiment is that the crusher is controlled to prevent the feeding hopper from overflowing. Hence, the feeding hopper will not be overfilled with material when the supply of material to the feeding hopper is increased. Hence, crushing operation may continue, and at a larger amount of material being crushed per unit of time.

According to one embodiment the method further comprises measuring the amount of material in the feeding hopper at least once per 5 seconds. An advantage of this embodiment is that also rather quick changes in the amount of material supplied to the feeding hopper can be accounted for, to prevent the feeding hopper from running empty, or overflowing.

According to one embodiment the method further comprises utilizing as said cone crusher an inertia cone crusher, the step of controlling at least one crusher operating parameter comprising controlling an rpm of the drive shaft driving an unbalance bushing to which an unbalance weight of the inertia cone crusher is mounted. An advantage of this embodiment is that the crushing effect in an inertia cone crusher responds very quickly to a change in the rpm. Hence, controlling the rpm of the drive shaft in an inertia cone crusher is a very efficient manner of controlling the amount of material that is present in the feeding hopper.

According to another embodiment the method further comprises utilizing as said cone crusher a cone crusher comprising an eccentric sleeve providing the crushing head with a gyratory movement, the step of controlling at least one crusher operating parameter comprising controlling a width of a discharge opening formed between the inner crushing shell and the outer crushing shell. An advantage of this embodiment is that in gyratory crushers having an eccentric sleeve the fastest control is often obtained by changing the width of the discharge opening. Hence, controlling the width of the discharge opening in a cone crusher provided with an eccentric sleeve is a very efficient manner of controlling the amount of material that is present in the feeding hopper.

A further object of the present invention is to provide a cone crusher which is efficient in handling variations in the supply of material to be crushed.

This object is achieved by means of a cone crusher comprising an inner crushing shell, supported on a crushing head, an outer crushing shell, a crushing chamber formed between the inner and outer crushing shells, a motor driving a drive shaft adapted to make the crushing head gyrate to crush material in the crushing chamber, and a feeding hopper arranged for feeding material to the crushing chamber. The cone crusher further comprises a measurement device arranged for measuring the amount of material that is present in the feeding hopper, and a control system which is configured for controlling, based on a measured amount of material present in the feeding hopper, at least one crusher operating parameter which is chosen among:

i) an rpm of the drive shaft, and ii) a width of a discharge opening formed between the inner crushing shell and the outer crushing shell.

An advantage of this cone crusher is that it can control its own operation, independent of auxiliary equipment such as feeders, and adapt its operation in situations of varying amounts of material being supplied to the feeding hopper, such that crushing operation can continue without having to be interrupted.

According to one embodiment, the control system is arranged for comparing a measured amount of material present in the feeding hopper to a minimum amount and to control, when the measured amount of material falls below the minimum amount, at least one of said crusher operating parameters to increase the amount of material present in the feeding hopper. An advantage of this embodiment is that the feeding hopper will not be emptied of material when the supply of material to the feeding hopper is reduced or even stopped.

According to one embodiment the control system is arranged for comparing a measured amount of material present in the feeding hopper to a maximum amount and to control, when the measured amount of material exceeds the maximum amount, at least one of said crusher operating parameters to reduce the amount of material present in the feeding hopper. An advantage of this embodiment is that the feeding hopper may be prevented from overflowing when the supply of material to the feeding hopper increases.

According to one embodiment the measurement device comprises at least one of: a level sensor, and a weight sensor. An advantage of these measurement devices is that they are efficient low cost devices for measuring the amount of material present in the feeding hopper.

According to one embodiment the control system is arranged for controlling the rpm of the drive motor making the crushing head gyrate. An advantage of this embodiment is that controlling the rpm of the drive motor can often be arranged at a low cost by, for example, a frequency converter in the case of an electrical motor, by controlling the fuel supply in the case of a diesel engine, or by controlling the hydraulic fluid pressure and/or flow in case of a hydraulic motor. Furthermore, controlling the rpm of the drive motor often provides a very fast change in the amount of material that passes through the crushing chamber. Hence, controlling the rpm of the drive motor making the crushing head gyrate is particularly efficient when the supply of material to the feeding chamber varies very quickly.

According to one embodiment the control system is arranged for controlling a discharge opening control device arranged for adjusting the width of the discharge opening. An advantage of this embodiment is that changing the discharge opening often has a drastic influence on the amount of material that passes through the crushing chamber. Hence, controlling the width of the discharge opening is particularly efficient when the supply of material to the feeding chamber varies within a very wide range.

According to one embodiment the crusher comprises a crushing head shaft piston to which the crushing head is connected, and an associated hydraulic fluid space adjusting the vertical position of the crushing head, the control system being arranged for controlling the width of the discharge opening by adjusting the amount of hydraulic fluid in the hydraulic fluid space. An advantage of this embodiment is that controlling the width of the discharge opening can be made during operation of the crusher, and with a quick response, since the hydraulic fluid supplied to the hydraulic fluid space will quickly move the crushing head to a new vertical position.

Further objects and features of the present invention will be apparent from the description and the claims.

BRIEF DESCRIPTION OF THE DRAWINGS

The invention will now be described in more detail with reference to the appended drawings in which.

DESCRIPTION OF PREFERRED EMBODIMENTS

Figure 1:
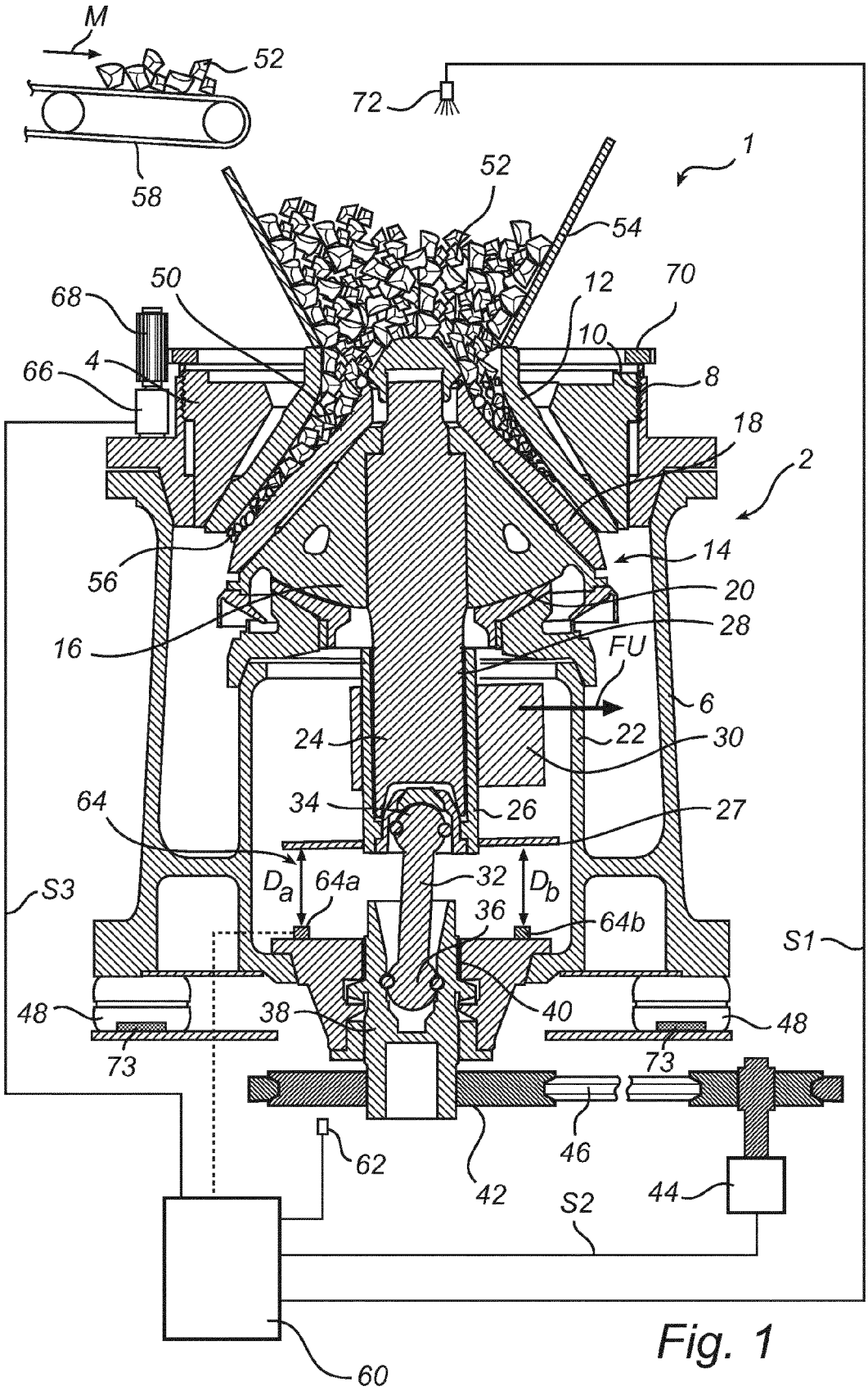
FIG. 1 is a schematic side view, in cross-section, and illustrates an inertia cone crusher.

FIG. 1 illustrates an inertia cone crusher 1. The inertia cone crusher 1 comprises a crusher frame 2 in which the various parts of the crusher 1 are mounted. The crusher frame 2 comprises an upper frame portion 4, and a lower frame portion 6. The upper frame portion 4 has the shape of a bowl and is provided with an outer thread 8, which co-operates with an inner thread 10 of the lower frame portion 6. The upper frame portion 4 supports, on the inside thereof, an outer crushing shell 12. The outer crushing shell 12 is a wear part which may be made from, for example, manganese steel.

The lower frame portion 6 supports an inner crushing shell arrangement 14. The inner crushing shell arrangement 14 comprises a crushing head 16, which has the shape of a cone and which supports an inner crushing shell 18, which is a wear part that can be made from, for example, a manganese steel. The crushing head 16 rests on a spherical bearing 20, which is supported on an inner cylindrical portion 22 of the lower frame portion 6.

The crushing head 16 is mounted on a crushing head shaft 24. At a lower end thereof, the crushing head shaft 24 is encircled by an unbalance bushing 26, which has the shape of a cylindrical sleeve. The unbalance bushing 26 is provided with an inner cylindrical bearing 28 making it possible for the unbalance bushing 26 to rotate relative to the crushing head shaft 24 about a central axis of the crushing head 16 and the crushing head shaft 24. In operation the crushing head 16 is made to gyrate about a vertical axis.

A gyration sensor reflection disc 27 extends radially from, and encircles, the unbalance bushing 26. The gyration sensor reflection disc 27 may be used for indirect determination of the revolutions per minute, rpm, of the crushing head 16.

An unbalance weight 30 is mounted on one side of the unbalance bushing 26. At its lower end the unbalance bushing 26 is connected to the upper end of a vertical transmission shaft 32 via a Rzeppa joint 34. Another Rzeppa joint 36 connects the lower end of the vertical transmission shaft 32 to a drive shaft 38, which is journalled in a drive shaft bearing 40. Rotational movement of the drive shaft 38 can thus be transferred from the drive shaft 38 to the unbalance bushing 26 via the vertical transmission shaft 32, while allowing the unbalance bushing 26 and the vertical transmission shaft 32 to be displaced from a vertical axis during operation of the crusher 1.

A pulley 42 is mounted on the drive shaft 38, below the drive shaft bearing 40. A motor 44, which may, for example, be an electrical motor or a diesel engine, is connected to the pulley 42 via a belt 46. According to an alternative embodiment the motor may be connected directly to the drive shaft 38.

The crusher 1 is suspended on cushions 48 to dampen vibrations occurring during the crushing action.

The outer and inner crushing shells 12, 18 form between them a crushing chamber 50, to which material 52 that is to be crushed is supplied from a feeding hopper 54 located above the crushing chamber 50. The width of a discharge opening 56 of the crushing chamber 50, and thereby the crushing capacity, can be adjusted by means of turning the upper frame portion 4, using the threads 8, 10, such that the distance between the shells 12, 18 is adjusted. Material 52 to be crushed may be transported to the feeding hopper 54 by a belt conveyor 58, as indicated by means of an arrow M.

The crusher 1 is driven by the drive shaft 38, which is rotated by means of the motor 44. The rotation of the drive shaft 38 causes the unbalance bushing 26 to rotate and as an effect of that rotation, the unbalance bushing 26 swings outwards, in the direction FU of the unbalance weight 30, displacing the unbalance weight 30 further away from the vertical axis, in response to the centrifugal force to which the unbalance weight 30 is exposed. Such displacement of the unbalance weight 30, and of the unbalance bushing 26 to which the unbalance weight 30 is attached, is allowed thanks to the flexibility of the Rzeppa joints 34, 36 of the vertical transmission shaft 32, and thanks to the fact that the crushing head shaft 24 may slide somewhat in the axial direction in the cylindrical bearing 28 of the unbalance bushing 26. The combined rotation and swinging of the unbalance bushing 26 causes an inclination of the crushing head shaft 24, and allows the central axis of the crushing head 16 and the crushing head shaft 24 to gyrate about a gyration axis, which, during normal operation for crushing material in the crusher 1, coincides with a vertical axis, such that material 52 is crushed in the crushing chamber 50 between the outer and inner crushing shells 12, 18.

A control system 60 is configured to control the operation of the crusher 1. The control system 60 is connected to the motor 44, for controlling the power and/or the revolutions per minute (rpm) of the motor 44. Such control could, for example, be achieved by the control system 60 controlling a frequency converter of the motor 44, in case the motor 44 is an electrical motor, by the control system 60 controlling the fuel supply, in case the motor 44 is a diesel engine, or by the control system 60 controlling the flow and/or pressure of hydraulic fluid, in case the motor 44 is a hydraulic motor. An rpm sensor 62 may be installed for direct measurement of the rpm of the drive shaft 38 or the pulley 42. The rpm of the drive shaft 38 and the pulley 42 is the same as the rpm of the unbalance bushing 26, and, hence, the rpm measured by the rpm sensor 62 is the same as the rpm of the unbalance bushing 26. An increase in the rpm of the motor 44, which corresponds to an increase in the rpm of the unbalance bushing 26, results in an increased amount of material, in tonnes per hour, passing through the crusher 1, and a reduced rpm of the motor 44, which corresponds to a reduced rpm of the unbalance bushing 26, results in a reduced amount of material, in tonnes per hour, passing through the crusher 1.

The control system 60 may also control the rpm of the unbalance bushing 26 by receiving readings from a gyration sensor 64, which senses the location and/or motion of the gyration sensor reflection disc 27. By way of example, the gyration sensor 64 may comprise three separate sensing elements, which are distributed in a horizontal plane beneath the gyration sensor reflection disc 27, for sensing three vertical distances to the gyration sensor reflection disc 27 in the manner described in detail in EP 2 116 307. Thereby, a complete determination of the tilt of the gyration sensor reflection disc 27, and, hence, also of the tilt, sometimes referred to as the gyrating amplitude, of the crushing head 16, may be obtained. In the section of FIG. 1, two sensing elements 64*a*, 64*b* of the sensor 64, for measuring two respective distances $D_a$, $D_b$, are illustrated; the third sensor is not visible in the section. It is also possible to obtain an indication of the gyrating amplitude of the crushing head 16 with two, and even with just one sensing element. For sensing of the distances $D_a$, $D_b$ to the gyration sensor reflection disc 27, the gyration sensor 64 may, for example, comprise sensing elements 64*a*, 64*b* that involve radar measurement devices, ultrasonic transceiver measurement devices, and/or optical transceiver devices. The control system 60 may control the motor 44 to an rpm that provides the desired gyrating amplitude.

To achieve the above mentioned control of the width of the discharge opening 56 of the crushing chamber 50 a discharge opening control device in the form of a discharge opening control motor 66 is mounted on the lower frame portion 6 and is arranged for rotating, by means of a gear 68, a gear rim 70 which is connected to the upper frame portion 4. Hence, the motor 66 is arranged for turning the upper frame portion 4, by means of the co-operation of the outer thread 8 connected to the upper frame portion 4 with the inner thread 10 connected to the lower frame portion 6. The control system 60 may control the control motor 66 to turn the gear rim 70 to make the upper frame portion 4 move, as an effect of the co-operation of the threads 8, 10, either upwards, causing an increased width of the discharge opening 56, or downwards, causing a reduced width of the discharge opening 56. An increase in the width of the discharge opening 56 results in an increased amount of material, in tonnes per hour, passing through the crusher 1, but such material being crushed to a relatively larger size, and a reduced width of the discharge opening 56 results in a reduced amount of material, in tonnes per hour, passing through the crusher 1, but such material being crushed to a relatively smaller size.

A measurement device in the form of a level sensor 72 is arranged above the feeding hopper 54 to measure the amount of material that is present in the feeding hopper 54. The level sensor 72 could be of the radar type, laser type, microwave type, ultrasonic type or another suitable type for measuring the amount of material present in the hopper 54. If the feeding hopper 54 would run empty of material there is a risk that the inner shell 18 might, in the absence of material 52 in the crushing chamber 50, get into direct physical contact with the outer shell 12 and cause damage thereto. The control system 60 is arranged for receiving signals from the level sensor 72 indicating the present level of material 52 in the feeding hopper 54. The supply of material 52 via the conveyor 58 may be very uneven, and may even become interrupted at some occasions. The control system 60 is arranged for controlling the operation of the crusher 1 to avoid that the feeding hopper 54 is either emptied of material, or that the feeding hopper 54 is overfilled with material.

In accordance with an alternative embodiment, the cushions 48 may be arranged on weight sensors 73, such as scales or load cells. Hence, a present combined weight of the crusher 1 and of the material 52 in the hopper 54 can be measured. The present amount of material 52 in the hopper 54 can be estimated by subtracting the known weight of an empty crusher 1 from the measured present total weight of crusher 1 plus material 52. If, for example, the weight sensors 73 measure a present total weight of 8.3 tonnes, and it is known that an empty crusher 1 has a weight of 7 tonnes, then the present amount of material 52 in the feeding hopper 54 is about 8.3−7=1.3 tonnes. Such measurement of the weight of material 52 that is present in the hopper 54 can be utilized as an alternative to, or in combination with, a level measurement for measuring the amount of material 52 that is present in the hopper 54.

In accordance with a first example, the amount of material 52, in the unit tonnes per hour, fed via the conveyor 58 to the crusher 1 suddenly increases from its previous amount to a higher amount. As an effect of such increase the level of material 52 in the feeding hopper 54 increases. The increasing level of material 52 in the feeding hopper 54 is registered by the level sensor 72 which sends a signal 51 to the control system 60. As an effect of the receipt of such signal 51, the control system 60 takes measures to increase the amount of material 52 that passes through the crusher 1. The control system 60 may, for example, send a signal S2 to the motor 44 to cause an increase in the rpm of the motor 44. Such increased rpm of the motor 44 causes an increase in the amount of material 52 passing through the crusher 1, and the level of material in the feeding hopper 54 stabilizes. As alternative to, or in combination with increasing the rpm of the motor 44, the control system 60 may also send a signal S3 to the discharge opening control motor 66 to cause the control motor 66 to turn the gear rim 70 to move the upper frame portion 4 upwards. Such moving upwards of the upper frame portion 4 causes an increase in the width of the discharge opening 56, which results in an increase in the amount of material 52 passing through the crusher, and the level of material in the feeding hopper 54 stabilizes.

In accordance with a second example, the amount of material 52 fed via the conveyor 58 to the crusher 1 is suddenly reduced from its previous amount to a lower amount. As an effect of such reduction the level of material 52 in the feeding hopper 54 decreases. The decreasing level of material 52 in the feeding hopper 54 is registered by the level sensor 72 which sends a signal 51 to the control system 60. As an effect of the receipt of such signal 51, the control system 60 takes measures to reduce the amount of material that passes through the crusher 1. The control system 60 may, for example, send a signal S2 to the motor 44 to cause a reduction in the rpm of the motor 44, such reduction causing a reduction in the amount of material 52 passing through the crusher 1, and the level of material in the feeding hopper 54 stabilizes. As alternative to, or in combination with reducing the rpm of the motor 44, the control system 60 may also send a signal S3 to the discharge opening control motor 66 to cause the control motor 66 to turn the gear rim 70 to move the upper frame portion 4 downwards to cause a reduction in the width of the discharge opening 56, and thereby a reduction in the amount of material 52 passing through the crusher 1, and the level of material in the feeding hopper 54 stabilizes.

Figure 2:
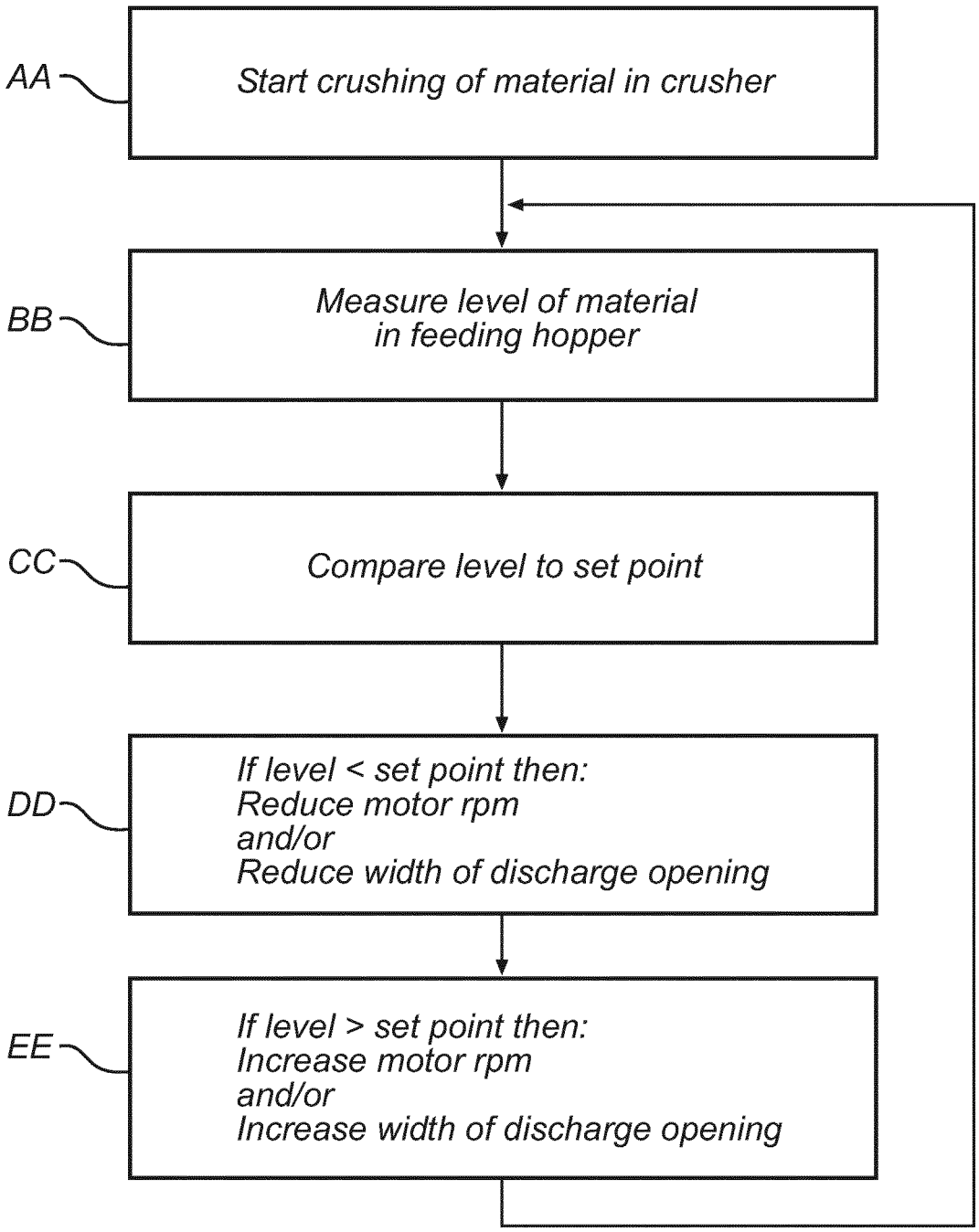
FIG. 2 is flow diagram illustrating a method of controlling a crusher.

FIG. 2 is a flow diagram illustrating the steps of an example of a method of controlling the operation of the crusher 1.

In a step AA the crushing of material 52 in the crusher 1 is started. Such is normally accomplished by the control system 60 ordering the motor 44 to start rotating the unbalance bushing 26 at a fixed rpm, for example 500 rpm. The control system 60 may also order the motor 66 to adjust the width of the discharge opening 56 to a desired value, for example 10 mm.

In a step BB the level of material 52 in the feeding hopper 54 is measured by means of the level sensor 72.

In a step CC the level as measured in step BB is compared to one or more set points. In accordance with one embodiment there is one minimum amount of material in the feeding hopper 54, formulated as a lower set point, for example a lower set point=80 cm, below which the amount of material in feeding hopper 54 should not decrease, and one maximum amount of material in the feeding hopper 54, formulated as an upper set point, for example an upper set point=120 cm, which the amount of material 52 in the feeding hopper 54 should not exceed. In accordance with another embodiment, there is one fixed set point, having the function of being both a minimum and a maximum amount of material, formulated as a single set point, for example a set point=100 cm, which corresponds to a desired amount of material 52 in the feeding hopper 54. Other alternative set points, and set points that vary over time and with the type of material crushed, etc. may also be utilized.

If it is determined that the level of material 52 in the feeding hopper 54 is below the set point then step DD is activated. This may be the case if, for example, the measured level of material 52 in the feeding hopper 54 is only 75 cm. In such case the control system 60 may control the motor 44 to reduce the rpm of the motor 44, for example to 400 rpm, to reduce the amount of material 52 that passes through the crusher 1. The control system 60 may also, either as alternative to reducing the rpm of the motor 44, or in combination therewith, order the control motor 66 to reduce the width of the discharge opening 56 to, for example, 8 mm to reduce the amount of material 52 that passes through the crusher 1. Hence, the crusher 1 continues to crush material 52, but with a lower amount of material 52 passing through the crusher 1 per unit of time.

If it is determined that the level of material in the feeding hopper 54 is above the set point then step EE is activated. This may be the case if, for example, the measured level of material 52 in the feeding hopper 54 is 130 cm. In such case the control system 60 may control the motor 44 to increase the rpm, for example to 600 rpm, to increase the amount of material 52 that passes through the crusher 1. The control system 60 may also, either as alternative to increasing the rpm of the motor 44, or in combination therewith, order the control motor 66 to increase the width of the discharge opening 56 to, for example, 12 mm to increase the amount of material 52 that passes through the crusher 1. Hence, the crusher 1 continues to crush material 52, and with a higher amount of material 52 passing through the crusher 1 per unit of time.

According to one embodiment the magnitude of the change in rpm of the drive shaft 38 and/or in the width of the discharge opening 56 corresponds to how much the measured amount of material is above or below the set point. For example, if the measured level of material 52 in the feeding hopper 54 is 30 cm below the set point, then the rpm of the drive shaft 38 could be reduced by 200 rpm from its normal value of 500 rpm, to 300 rpm, while a measured level of material 52 in the feeding hopper 54 being only 5 cm below the set point could result in a reduction in the rpm of only 25 rpm from its normal value of 500 rpm, to 475 rpm. Hence, the magnitude of the response, i.e. the change in rpm and/or width, to a deviation from the set point could be proportional to the measured deviation, for example in a linear relation, or according to another suitable mathematical relation.

Furthermore, the magnitude of the response could also be proportional to the rapidness of the changes in the measured amount of material 52 in the hopper 54. Hence, for example, if the measured level of material 52 in the feeding hopper 54 increases very quickly to 20 cm above the set point, then the width of the discharge opening 56 could be increased from 10 mm to 15 mm. If, on the other hand, the measured level of material 52 in the feeding hopper 54 increases slowly to 20 cm above the set point, then the width of the discharge opening 56 could be increased only from 10 mm to 12 mm.

Following step EE the sequence of steps BB and CC is repeated to check whether or not the measures taken in step DD or EE has been sufficient to adjust the level of material 52 in the feeding hopper 54 to a suitable value in view of the set point there for, or if further adjustments to the rpm of the motor 44 and/or the width of the discharge opening 56 are required.

It will be appreciated that the control system 60 may involve a PID-regulator which controls, on a more or less continuous basis, the rpm of the drive motor 44 and/or the operation of the discharge opening control motor 66 in accordance with the above mentioned principles to bring the level of material 52 in the feeding hopper 54 to a level which is as close as possible to the set point. Level measurements are preferably performed by the level sensor 72 at least once every 5 seconds, preferably at least once per second, and most preferably almost continuously, with several measurements per second in accordance with the measurement frequency of the level sensor 72, and corresponding signals S1 are sent to the control system 60.

Figure 3:
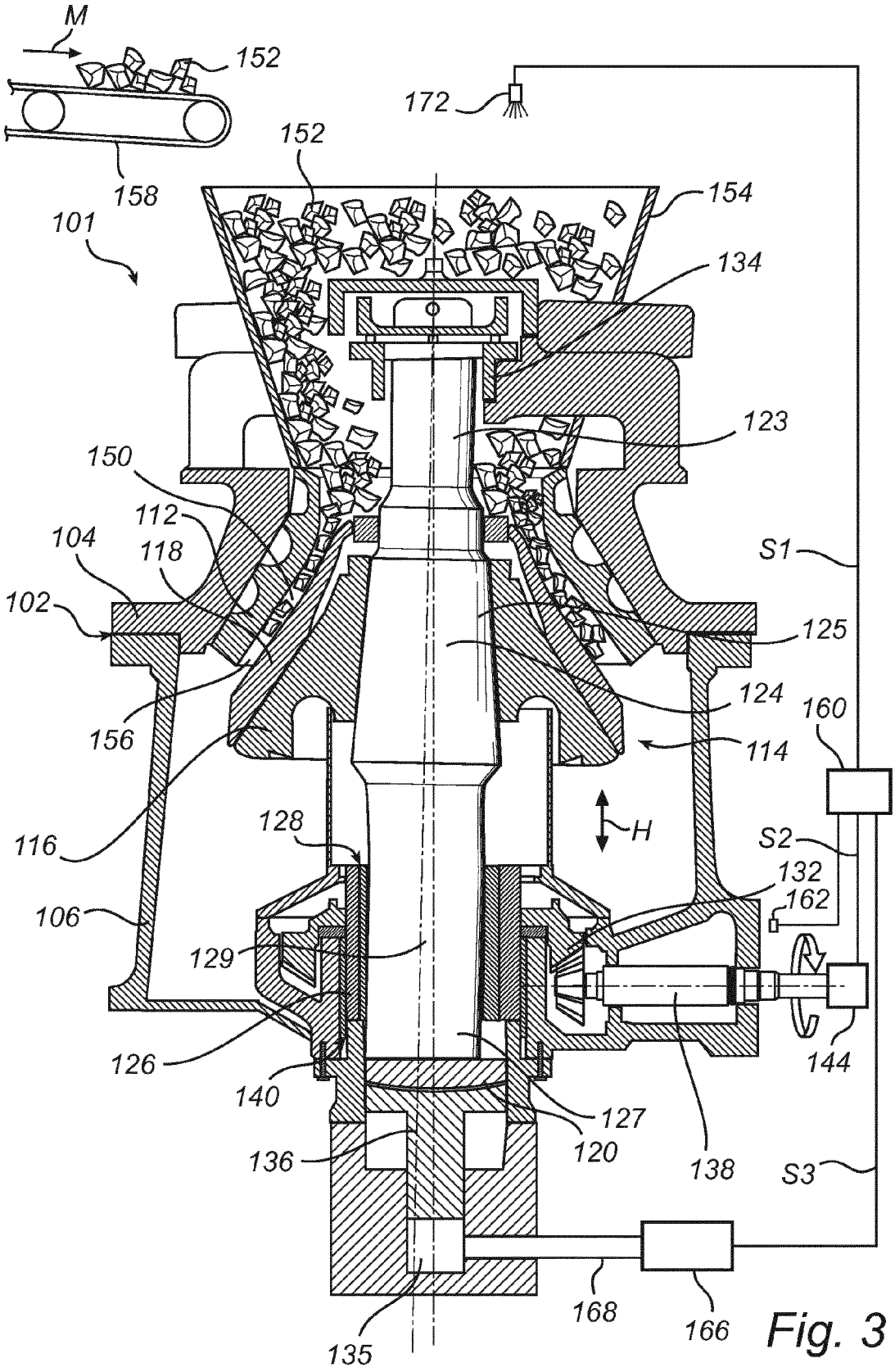
FIG. 3 is a schematic side view, in cross-section, and illustrates a cone crusher comprising an eccentric sleeve.

FIG. 3 schematically illustrates a cone crusher 101 in section. The cone crusher 101 is of the type in which an eccentric sleeve 126 provides a crushing head 116 with a gyratory movement. The cone crusher 101 comprises a crusher frame 102 in which the various parts of the crusher 101 are mounted. The crusher frame 102 comprises an upper frame portion 104, and a lower frame portion 106. The upper and lower frame portions 104, 106 are mounted to each other in a fixed manner by means of, for example, bolts. The upper frame portion 104 has the shape of a bowl and supports, on the inside thereof, an outer crushing shell 112, the latter being a wear part which may be made from, for example, manganese steel.

The lower frame portion 106 supports an inner crushing shell arrangement 114. The inner crushing shell arrangement 114 comprises the crushing head 116, which has the shape of a cone and which is mounted on a central portion 125 of a crushing head shaft 124. The crushing head 116 supports an inner crushing shell 118, which is a wear part that can be made from, for example, a manganese steel. The crushing head shaft 124 is carried at its upper end 123 in a top bearing 134 mounted in the upper frame portion 104.

The eccentric sleeve 126 is rotatably arranged about the lower portion 129 of the crushing head shaft 124. The crushing head shaft 124 is radially supported in the eccentric sleeve 126 via an inner slide bearing 128, which allows the crushing head shaft 124 to rotate in the eccentric sleeve 126. The eccentric sleeve 126 is radially supported in the lower frame portion 106 via an outer slide bearing 140, which allows the eccentric sleeve 126 to rotate in the lower frame portion 106. Together, the eccentric sleeve 126 and the inner and outer slide bearings 128, 140 form an eccentric bearing arrangement for guiding the crushing head shaft 124 and the crushing head 116 along a gyratory path.

A drive shaft 138 is arranged to rotate the eccentric sleeve 126 by means of a gear rim 132 mounted on the eccentric sleeve 126. A drive motor 144, which may be an electrical motor, a hydraulic motor, or a diesel engine, is arranged for rotating the drive shaft 138. When the drive motor 144 makes the drive shaft 138 rotate the eccentric sleeve 126, during operation of the crusher 101, the crushing head shaft 124 and the crushing head 116 mounted thereon will execute a gyrating movement.

At its lower end 127 the crushing head shaft 124 is supported on a thrust bearing 120. The thrust bearing 120 is mounted on an upper face of a crushing head shaft piston 136. The vertical position of the crushing head shaft piston 136, and, hence, the vertical position of the head shaft 124 being supported thereby, may be hydraulically adjusted by controlling the amount of hydraulic fluid present in a hydraulic fluid space 135 at the lower end of the piston 136. A discharge opening control device in the form of a hydraulic pump system 166 is arranged for pumping hydraulic fluid to the hydraulic fluid space 135 via a hydraulic fluid supply pipe 168. By controlling the amount of hydraulic fluid that is supplied to the hydraulic fluid space 135 the vertical position of the crushing head shaft 124 can be controlled, as indicated by an arrow H. Such control of the vertical position of the head shaft 124 also controls the vertical position of the crushing head 116, and of the inner crushing shell 118, and hence controls the width of a discharge opening 156 between the inner and outer crushing shells 118, 112.

The outer and inner crushing shells 112, 118 form between them a crushing chamber 150, to which material 152 that is to be crushed is supplied from a feeding hopper 154 located above the crushing chamber 150. When the crusher 101 is operated, material 152 to be crushed is introduced in the crushing chamber 150 and is crushed between the inner crushing shell 118 and the outer crushing shell 112 as a result of the gyrating movement of the crushing head 116.

Material 152 to be crushed may be transported to the feeding hopper 154 by a belt conveyor 158, as indicated by means of an arrow M. A level sensor 172 is arranged above the feeding hopper 154 to measure the amount of material 152 that is present in the feeding hopper 154. The supply of material via the conveyor 158 may be very uneven, and may even become interrupted for some periods. A control system 160 is arranged for receiving signals from the level sensor 172 indicating the present level of material 152 in the feeding hopper 154. The control system 160 is arranged for controlling the operation of the crusher 101 to avoid that the feeding hopper 154 is either emptied of material, or that the feeding hopper 154 is overfilled with material. The control system 160 may, for this purpose, control the power and/or the revolutions per minute (rpm) of the motor 144. An rpm sensor 162 may be installed for direct measurement of the rpm of the drive shaft 138. An increase in the rpm of the motor 144, which corresponds to an increase in the rpm of the eccentric sleeve 126, results in an increased amount of material 152, in tonnes per hour, passing through the crusher 101, and a reduced rpm of the motor 144, which corresponds to a reduced rpm of the eccentric sleeve 126, results in a reduced amount of material 152, in tonnes per hour, passing through the crusher 101.

As alternative to, or in combination with controlling the rpm of the eccentric sleeve 126, the control system 160 may control the hydraulic pump system 166 pumping hydraulic fluid to the hydraulic fluid space 135. The hydraulic pump system 166 could increase the amount of hydraulic fluid present in the hydraulic fluid space 135, in which case the piston 136, the thrust bearing 120, the head shaft 124, the crushing head 116 and the inner crushing shell 118 move upwards causing a reduced width of the discharge opening 156. As alternative, the hydraulic pump system 166 could reduce the amount of hydraulic fluid present in the hydraulic fluid space 135, in which case the piston 136, the thrust bearing 120, the head shaft 124, the crushing head 116 and the inner crushing shell 118 would move downwards causing an increased width of the discharge opening 156. A reduced width of the discharge opening 156 results in a reduced amount of material 152 passing through the crusher 101, but such material being crushed to a relatively smaller size, and an increase in the width of the discharge opening 156 results in an increased amount of material 152 passing through the crusher 101, but such material being crushed to a relatively larger size.

In accordance with a first example, the amount of material 152 fed via the conveyor 158 to the crusher 101 suddenly increases from its previous amount to a higher amount causing an increase in the level of material 152 in the feeding hopper 154. The increasing level of material 152 in the feeding hopper 154 is registered by the level sensor 172 which sends a signal S1 to the control system 160. As an effect of the receipt of such signal S1, the control system 160 takes measures to increase the amount of material that passes through the crusher 101. The control system 160 may, for example, send a signal S2 to the motor 144 to cause an increase in the rpm of the motor 144 resulting in an increase in the amount of material 152 passing through the crusher 101, such that the level of material in the feeding hopper 154 stabilizes. As alternative to, or in combination with increasing the rpm of the motor 144, the control system 160 may also send a signal S3 to the hydraulic pump system 166 to cause a lowering of the piston 136 and a resulting increase in the width of the discharge opening 156, which results in an increase in the amount of material 152 passing through the crusher 101, and the level of material 152 in the feeding hopper 154 stabilizes.

In accordance with a second example, the amount of material 152 fed via the conveyor 158 to the crusher 101 is suddenly reduced from its previous amount to a lower amount causing a decreasing level of material 152 in the feeding hopper 154. The decreasing level of material in the feeding hopper 154 is registered by the level sensor 172 which sends a signal S1 to the control system 160. The control system 160 takes measures to reduce the amount of material that passes through the crusher 101. The control system 160 may, for example, send a signal S2 to the motor 144 to cause a reduction in the rpm of the motor 144, resulting in a reduction in the amount of material passing through the crusher 101, and the level of material 152 in the feeding hopper 154 stabilizes. As alternative to, or in combination with reducing the rpm of the motor 144, the control system 160 may also send a signal S3 to the hydraulic pump system 166 to cause a rising of the piston 136 and a resulting reduction in the width of the discharge opening 156, which results in a decrease in the amount of material passing through the crusher 101, and the level of material in the feeding hopper 154 stabilizes.

The method disclosed hereinabove with reference to FIG. 2 may be applied to the cone crusher 101 of FIG. 3 as well, with the difference that it is the hydraulic pump system 166 instead of the discharge opening control motor 66 that is utilized for controlling the width of the discharge opening 156. Hence, crushing operation in the crusher 101 may continue also when the supply of material 152 to the feeding hopper 154 is increased or is reduced.

It will be appreciated that numerous variants of the above described embodiments are possible within the scope of the appended claims.

Hereinbefore it has been described that the control system 60, 160 is arranged for controlling the rpm of the drive motor 44, 144. It will be appreciated that the control system 60,160 may also control the rpm of the drive shaft 38, 138 in other manners. For example, the control system 60, 160 may control the rpm of the drive shaft 38, 138 by controlling a transmission, such as a gear box, arranged between the motor 44, 144 and the drive shaft 38, 138.

Hereinbefore it has been described that the cone crusher may be an inertia cone crusher 1, as described with reference to FIG. 1, or a cone crusher 101 comprising an eccentric sleeve 126 providing the crushing head 116 with a gyratory movement, as described with reference to FIG. 3. It will be appreciated that the present method and device may also be applied to other types of cone crushers, including, for example, cone crushers in which the crushing head gyrates about a fixed shaft as disclosed in, for example, WO 2010/071566 and having a hydraulic or mechanic adjustment system for adjusting the width of the discharge opening.

The invention claimed is:

1. A method of controlling the crushing of material in a cone crusher having an inner crushing shell supported on a crushing head and an outer crushing shell, the inner and outer crushing shells forming between them a crushing chamber, the method comprising the steps of:

supplying material (52) to a feeding hopper arranged above the crushing chamber;

feeding the material from the feeding hopper to the crushing chamber;

bringing the crushing head to gyrate by means of a drive shaft driven by a drive motor to crush the material in the crushing chamber;

measuring an amount of the material that is present in the feeding hopper; and controlling, based on the measured amount of material present in the feeding hopper, at least one crusher operating parameter which is chosen from the group of an rpm of the drive shaft and a width of a discharge opening formed between the inner crushing shell and the outer crushing shell.

2. A method according to claim 1, further comprising the step of controlling, when the measured amount of material present in the feeding hopper falls below a minimum amount, at least one of said crusher operating parameters to increase the amount of material present in the feeding hopper.

3. A method according to claim 1, wherein said step of measuring an amount of material that is present in the feeding hopper comprises measuring a level and/or a weight of the material present in the feeding hopper.

4. A method according to claim 1, further comprising the step of controlling, when the measured amount of material present in the feeding hopper exceeds a maximum amount, at least one of said crusher operating parameters to reduce the amount of material present in the feeding hopper.

5. A method according to claim 1, further comprising measuring the amount of material in the feeding hopper at least once per 5 seconds.

6. A method according to claim 1, wherein said cone crusher is an inertia cone crusher and further comprising the step of controlling at least one crusher operating parameter comprising controlling an rpm of the drive shaft driving an unbalance bushing to which an unbalance weight of the inertia cone crusher (1) is mounted.

7. A method according to claim 1, wherein the cone crusher includes an eccentric sleeve providing the crushing head with a gyratory movement, the step of controlling at least one crusher operating parameter comprising controlling a width of a discharge opening formed between the inner crushing shell and the outer crushing shell.

8. A cone crusher including an inner crushing shell supported on a crushing head, an outer crushing shell, a crushing chamber formed between the inner and outer crushing shells, a motor driving a drive shaft to gyrate the crushing head to crush material in the crushing chamber, and a feeding hopper arranged for feeding material to the crushing chamber, the cone crusher comprising:

a measurement device for measuring the amount of material that is present in the feeding hopper; and a control system for controlling, based on the measured amount of material present in the feeding hopper, at least one crusher operating parameter which is chosen from the group of an rpm of the drive shaft, and a width of a discharge opening formed between the inner crushing shell and the outer crushing shell.

9. A cone crusher according to claim 8, wherein the control system includes means for comparing a measured amount of the material present in the feeding hopper to a minimum amount and to control, when the measured amount of material falls below the minimum amount, at least one of said crusher operating parameters to increase the amount of material present in the feeding hopper.

10. A cone crusher according to claim 8, wherein the control system includes means for comparing a measured amount of material present in the feeding hopper to a maximum amount and to control, when the measured amount of material exceeds the maximum amount, at least one of said crusher operating parameters to reduce the amount of material present in the feeding hopper.

11. A cone crusher according to claim 8, wherein the measurement device is a level sensor.

12. A cone crusher according to claim 8, wherein the control system includes means for controlling the rpm of the drive motor to make the crushing head gyrate.

13. A cone crusher according to claim 8, wherein the control system includes means for controlling a discharge opening control device arranged for adjusting the width of the discharge opening.

14. A cone crusher according to claim 8, wherein the crusher is an inertia cone crusher, the control system including means for controlling the rpm of the drive shaft and driving an unbalance bushing to which an unbalance weight of the inertia cone crusher is mounted.

15. A cone crusher according to claim 8, wherein the crusher is a cone crusher including an eccentric sleeve for providing the crushing head with a gyratory movement, the control system including means for controlling the width of the discharge opening.

16. A cone crusher according to claim 15, further comprising a crushing head shaft piston to which the crushing head is connected, and an associated hydraulic fluid space for adjusting a vertical position of the crushing head, the control system including means for controlling the width of the discharge opening by adjusting an amount of hydraulic fluid in a hydraulic fluid space.

17. A cone crusher according to claim 8, wherein the measurement device is a weight sensor.

* * * * *